US007362284B2

(12) United States Patent
Legay et al.

(10) Patent No.: US 7,362,284 B2
(45) Date of Patent: Apr. 22, 2008

(54) MULTIPOLARIZATION RADIATING DEVICE WITH ORTHOGONAL FEED VIA SURFACE FIELD LINE(S)

(75) Inventors: Hervé Legay, Plaisance du Touch (FR); Guillaume Lathiere, Rennes (FR); Raphaël Gillard, Rennes (FR)

(73) Assignee: Thales, Neuilly-sur-Seine (FR)

( * ) Notice: Subject to any disclaimer, the term of this patent is extended or adjusted under 35 U.S.C. 154(b) by 0 days.

(21) Appl. No.: 11/058,285

(22) Filed: Feb. 16, 2005

(65) Prior Publication Data

US 2005/0179598 A1 Aug. 18, 2005

(30) Foreign Application Priority Data

Feb. 17, 2004 (FR) ..... 04 50284

(51) Int. Cl.
*H01Q 1/48* (2006.01)

(52) U.S. Cl. ..... 343/846; 343/700 MS

(58) Field of Classification Search ..... 343/700 MS, 343/702, 846, 848
See application file for complete search history.

(56) References Cited

U.S. PATENT DOCUMENTS 4,686,536 A * 8/1987 Allcock ..... 343/700 MS
6,188,371 B1 * 2/2001 Li et al. ..... 343/866
6,344,833 B1 * 2/2002 Lin et al. ..... 343/846
6,404,394 B1 * 6/2002 Hill ..... 343/702
6,642,890 B1 * 11/2003 Chen ..... 343/700 MS
6,765,537 B1 * 7/2004 Apostolos ..... 343/741
6,927,730 B2 * 8/2005 Tang et al. ..... 343/700 MS
6,933,897 B2 * 8/2005 Asano et al. ..... 343/702
6,937,193 B2 * 8/2005 Hendler et al. ..... 343/700 MS
6,992,627 B1 * 1/2006 Honda et al. ..... 343/700 MS
2002/0149523 A1 * 10/2002 Fang et al. ..... 343/702
2003/0043075 A1 * 3/2003 Bit-Babik et al. ... 343/700 MS
2004/0070537 A1 * 4/2004 Kadambi et al. .... 343/700 MS
2004/0150566 A1 * 8/2004 Yuanzhu ..... 343/700 MS
2004/0212535 A1 * 10/2004 Tang et al. ..... 343/700 MS
2005/0179595 A1 * 8/2005 Yamamoto ..... 343/700 MS
2006/0017620 A1 * 1/2006 Chen et al. ..... 343/700 MS

OTHER PUBLICATIONS

N. I. Hersovicio et al, "Full-Wave Solution for an Aperture-Coupled Patch Fed by Perpendicular Coplanar Strips", IEEE Transactions on Antennas and Propagation, IEEE, Inc., New York, U., vol. 42, No. 4 Apr. 1, 1994 pp. 544-547, XP000450169.
"Thermocompression Bonded High Density Cable Design", Research Disclosure, Kenneth Mason Publications, Hampshire, GB, No. 303, Jul. 1, 1989, p. 546 XP000045872.

(Continued)

*Primary Examiner*—Thuy V Tran
*Assistant Examiner*—Tung X Le
(74) *Attorney, Agent, or Firm*—Sughrue Mion, PLLC

(57) ABSTRACT

A radiating device for an antenna comprises a first ground plane comprising a surface electric field main feed line, a second ground plane substantially perpendicular to the first ground plane and comprising electromagnetic coupling means fed orthogonally by a first end of the main feed line, and a resonant structure adapted to radiate energy in the event of excitation by electromagnetic coupling at the first end of the main feed line via the coupling means.

22 Claims, 14 Drawing Sheets

OTHER PUBLICATIONS

K. W. Leung et al, "Slot-coupled dielectric resonator antenna using a proximity feed on a perpendicular substrate", Electronics Letters, IEEE Stevenage, GB, Vo9l. 33, No. 20, Sep. 25, 1997, pp. 1665-1666, XP006008015.

K. W. Leung et al, "Analysis of Aperture-Coupled Hemispherical Dielectric Resonator Antenna with a Perpendicular Feed", IEEE Transactions on Antennas and Propagation, IEEE, Inc. New York, US, vol. 48, No. 6, Jun. 2000, pp. 1005-1007, XP000959058.

N. K. Das, "Rigorous Analysis of an Aperture-Coupled Microstrip Antenna Fed by a Microstrip Line on a Perpendicular Substrate", IEEE Microwave and Guided Wave Letters, IEEE, Inc., NY, US, vol. 4, No. 6 Jun. 1, 1994, pp. 202-204 XP000454558.

* cited by examiner

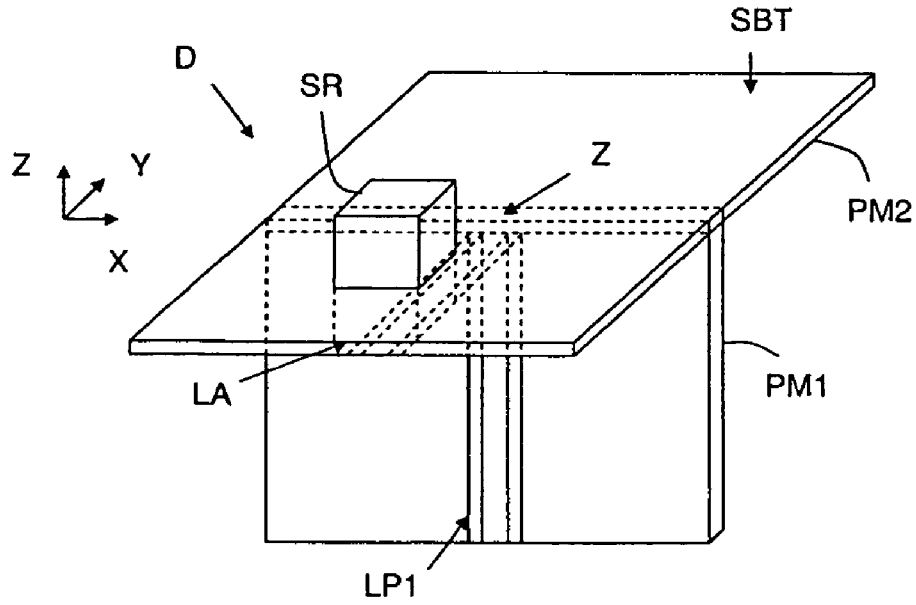
FIG.1
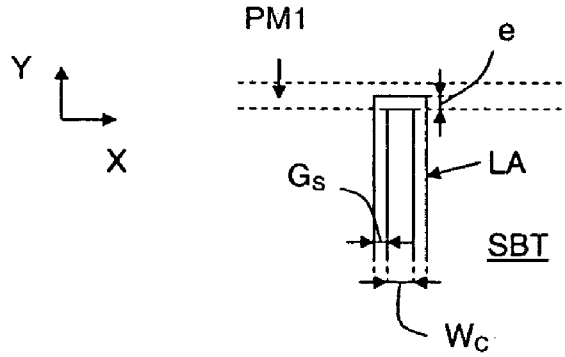
FIG.2
FIG.3
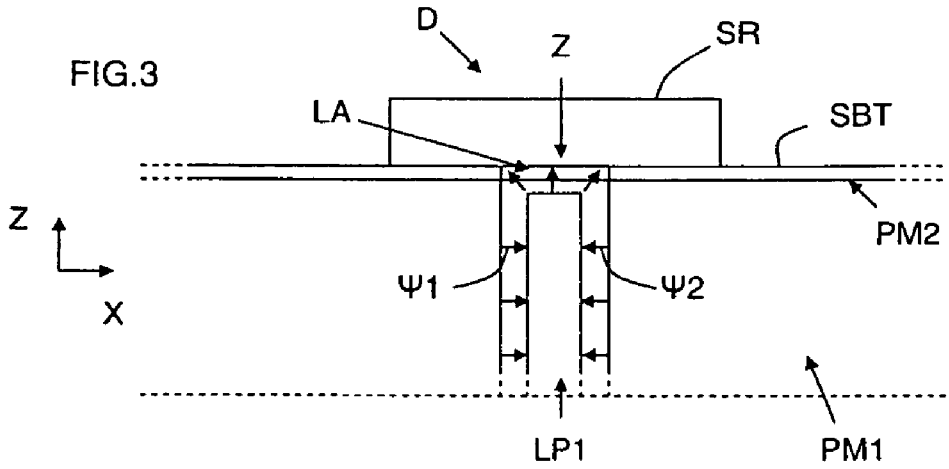

MULTIPOLARIZATION RADIATING DEVICE WITH ORTHOGONAL FEED VIA SURFACE FIELD LINE(S)

CROSS-REFERENCE TO RELATED APPLICATIONS

This application is based on French Patent Application No. 04 50 284 filed 17 Feb. 2004, the disclosure of which is hereby incorporated by reference thereto in its entirety, and the priority of which is hereby claimed under 35 U.S.C. §119.

BACKGROUND OF THE INVENTION

1. Field of the Invention

The invention relates to the field of transmit and/or receive antennas, and more particularly to the radiating devices (or elements) of such antennas.

2. Description of the Prior Art

In the present context the term "radiating device" means a combination comprising at least a main feed line, a radiating ground plane and a resonant structure for radiating energy at a selected wavelength λ when it is excited by the main feed line, where applicable via coupling means forming part of the radiating ground plane.

The term "antenna" means not only conventional antennas such as focal array antennas, for example FAFR or passive multibeam reflector antennas, but also direct radiating active array antennas.

As the person skilled in the art knows, radiating devices or elements are usually fed by electromagnetically coupling the resonant structure to the feed line, which is parallel to the radiating ground plane and implemented in a planar technology. The feed line may be of the microstrip, coplanar or triplate type, for example, and may be coupled to the resonant structure either by proximity coupling or by electromagnetic coupling via a coupling slot formed in the radiating ground plane.

This planar technology gives rise to a certain number of technical problems.

The feed circuit being placed on or under the radiating ground plane, the resonant structure may be adversely affected by unwanted radiation or stray coupling.

The feed circuit being placed parallel to the ground plane, it is difficult to insert active equipments into the mesh of the array, such as low noise-amplifiers (LNA) or high-power amplifiers (HPA) and/or phase-shifter cells, whose dimensions are typically around 0.6λ. This problem is accentuated if the array operates with orthogonal polarizations, because it is then necessary to duplicate certain equipments (in particular certain active equipments). It is therefore insertion constraints that impose the minimum mesh sizes of the arrays. In other words, the planar technology is an obstacle to the compactness of certain array antennas.

An alternative feed is proposed in the IST Multikara 30 GHz focal array antenna project, and uses a microstrip to access guide transition followed by widening of the access guide to constitute a horn. This kind of transition cannot be used if compactness is a decisive criterion. Furthermore, it rules out dual polarization in the radiating ground plane.

Another alternative feed is proposed in the paper by K. W. Leung and M. W. To entitled "Aperture-coupled dielectric resonator antenna with a perpendicular feed", Electronic Letters, June 1997, vol. 33, No. 12, pages 1000-1001, and feeds a dielectric resonator placed on a radiating ground plane with a microstrip line placed on another ground plane perpendicular to the radiating ground plane and having an electrical field that is "buried", i.e. between the line and the perpendicular ground plane. This kind of solution has definite advantages in terms of isolation of the dielectric resonator and the room available for implanting equipments, but offers only a limited number of degrees of freedom, thereby making it difficult to obtain simultaneously a wide bandwidth and good quality of radiation.

No radiating device (or element) known in the art providing an entirely satisfactory solution, the invention therefore has the object of improving on the situation.

SUMMARY OF THE INVENTION

To this end the invention proposes a radiating device for an antenna, comprising a first ground plane comprising a surface electric field main feed line, a second ground plane substantially perpendicular to said first ground plane, preferably electrically connected to the latter at least near the main feed line, and comprising electromagnetic coupling means fed orthogonally by a first end of said main feed line, and a resonant structure adapted to radiate energy at a selected wavelength λ in the event of excitation by electromagnetic coupling at the first end of said main feed line via said coupling means of said second ground plane.

In the present context the expression "surface electric field feed line" means either a coplanar line or a slotted (or microslotted) line.

The resonant structure is preferably chosen from patches, dielectric resonators and air resonators (λ/4 thick).

In a first embodiment, the coupling means comprise a coplanar auxiliary feed line substantially perpendicular to the main feed line and having a first end coupled to the first end of the main feed line and a second end coupled by a proximity effect to the resonant structure.

In a second embodiment dedicated to monopolarization, the coupling means comprise a coupling slot of selected shape adapted to couple the first end of the main feed line and the resonant structure.

The second embodiment has a number of variants, in particular:

- the coupling slot may have a rectangular general shape defined by a longitudinal direction and a transverse direction and the main feed line is of the slotted type and has a first end substantially parallel to the transverse direction and placed substantially in the middle of the coupling slot; in this case the main feed line may comprise a microslot impedance adapter ("stub") at a selected distance from its first end; the first ground plane may comprise a coplanar connecting line having a first end of selected shape and a second end in which propagate first and second antiparallel surface electric fields and the main feed line may have a second end of selected shape adapted to cooperate with the first end of the connecting line to transform the second surface electric field into the first surface electric field adapted to excite the resonant structure;
- the coupling slot may have a rectangular general shape defined by a longitudinal direction and a transverse direction and the main feed line is of the coplanar type and is substantially parallel to the longitudinal direction; in this case the first end of the main feed line may open onto the middle of a longitudinal side of the coupling slot; alternatively, the coupling slot may have a longitudinal side extended perpendicularly, in the middle, by two adaptation microslots ("stubs") of selected dimensions, parallel to each other and spaced from each other by a selected distance; the first end of the main feed line then opens substantially at the connection between the longitudinal side of the coupling slot and the adaptation microslots;

the coupling slot may have a rectangular general shape defined by a longitudinal direction and a transverse direction and the main feed line is of the coplanar type and has, in a middle portion of the coupling slot, a first bent end substantially parallel to its transverse direction.

In a third embodiment dedicated to multipolarization the device comprises a third ground plane substantially perpendicular to the first ground plane and the second ground plane and comprising at two selected locations two substantially parallel coplanar main feed lines and the first ground plane comprises at two selected locations two substantially parallel coplanar main feed lines and the coupling means comprise a coupling slot having a cruciform general shape with a first branch and a second branch that are substantially perpendicular, the first branch having two opposite ends respectively coupled to the two main feed lines of the first ground plane and the second branch having two opposite ends respectively coupled to the two main feed lines of the third ground plane to provide double linear polarization.

For example, in this first embodiment the first branch may have a longitudinal side extended, at both ends, by two adaptation microslots of selected size and shape and having connecting portions substantially perpendicular to the longitudinal side and spaced by a selected distance; the first end of each main feed line of the first ground plane then opens substantially at the connection between one of the ends of the longitudinal side of the first branch and the connecting portions of the adaptation microslots. The second branch then has a longitudinal side extended, at both ends, by two adaptation microslots of selected size and shape and having connecting portions substantially perpendicular to the longitudinal side and spaced from each other by a selected distance, the first end of each main feed line of the third ground plane opening substantially at the connection between one of the ends of the longitudinal side of the second branch and the connecting portions of the adaptation microslots. For example, each adaptation microslot may have an end portion extending its connecting portion at a selected angle.

In a fourth embodiment also dedicated to multipolarization the device comprises a feed structure comprising four walls physically connected in pairs to define an open cylinder of square cross section. The first wall consists of the first ground plane comprising a slotted main feed line. The second wall consists of a third ground plane substantially perpendicular to the first ground plane and the second ground plane and comprises a slotted main feed line. The third wall consists of a fourth ground plane substantially perpendicular to the second ground plane and the third ground plane and comprises a slotted main feed line. The fourth wall consists of a fifth ground plane substantially perpendicular to the first ground plane, the second ground plane, and the fourth ground plane, and comprises a slotted main feed line. The coupling means comprise a coupling slot having a cruciform general shape with a first branch and a second branch that are substantially perpendicular; the first branch has two opposite ends respectively coupled to the main feed lines of the first ground plane and the fourth ground plane and the second branch has two opposite ends respectively coupled to the main feed lines of the third ground plane and the fifth ground plane to provide double linear polarization.

In a fifth embodiment also dedicated to multipolarization the device comprises a third ground plane substantially perpendicular to the first ground plane and the second ground plane and comprising at two selected locations two slotted main feed lines that are substantially parallel. The first ground plane comprises at two selected locations two substantially parallel slotted main feed lines. The coupling means comprise a coupling slot having a general shape resembling a pound symbol and a first branch, a second branch, a third branch and a fourth branch that are substantially perpendicular in pairs, the first branch and the third branch being respectively coupled by a middle portion to the main feed lines of the first ground plane and the second branch and the fourth branch being respectively coupled by a middle portion to the main feed lines of the third ground plane to provide double linear polarization. For example, the first ground plane and the third ground plane may each comprise a coplanar connecting line having one end divided into two portions defining the two slotted main feed lines.

The coupling between the resonant structure and the coupling slot may be of the inductive, capacitive or dipolar electric type.

The second ground plane is preferably formed on a buffer substrate having a thickness selected to adapt the impedance.

Finally, the device may comprise a horn coupling (by a proximity effect) to the radiating structure so as to be excited thereby in order to radiate the energy in accordance with a selected template.

The invention also proposes an antenna, where applicable of the array type, equipped with at least one radiating device of the type described hereinabove.

The invention is particularly well adapted, although not exclusively so, to focal array antennas, for example multibeam reflector antennas and direct radiation active array antennas.

BRIEF DESCRIPTION OF THE DRAWINGS

Other features and advantages of the invention will become apparent on reading the following detailed description and examining the appended drawings, in which:

FIG. 1 is a diagram of a first embodiment of a radiating device of the invention, FIG. 2 is a plan view in the XY plane of a portion of the FIG. 1 radiating device, FIG. 3 is a front view in the XZ plane of a portion of the FIG. 1 radiating device.

DETAILED DESCRIPTION OF PREFERRED EMBODIMENTS

Figure 4:
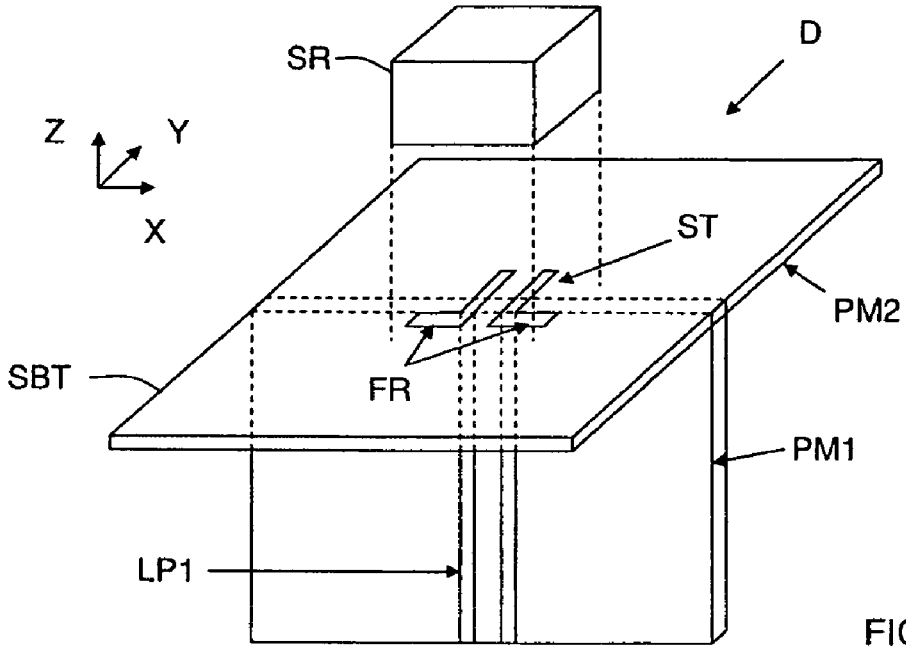
FIG. 4 is a diagram of a second embodiment of a radiating device of the invention.

The appended drawings constitute part of the description of the invention and may, if necessary, contribute to the definition of the invention.

An object of the invention is to allow, at will, radiation in monopolarization mode or multipolarization mode using an orthogonal feed radiating device (or element).

A radiating device of this kind is intended to be integrated into an antenna, preferably into an array antenna, for example a focal array antenna, such as a multibeam reflector antenna (of FAFR or passive type), or a direct radiation active array antenna. It may equally well be incorporated into a primary reflector source, especially if the source is of the two-band type (in this case, the invention frees up space for excitation of the some horn in a lower band, as explained hereinafter).

A first embodiment of a radiating device D of the invention suitable for monopolarization is described first with reference to FIGS. 1 to 3.

A radiating device D of the invention comprises firstly a first ground plane PM1 disposed in an XZ plane and including one or more surface electric field main feed lines LP1 adapted to be connected to antenna equipments, for example an amplifier integrated circuit, such as an MMIC (where applicable including a low-noise amplifier (LNA) or a high-power amplifier (HPA)), or a phase-shifter cell. In this first embodiment, the surface electric field feed line LP1 is a coplanar line, but it could be a slotted (or microslotted) line, as explained hereinafter.

The device D also comprises a second ground plane PM2, disposed in a plane XY substantially perpendicular to the first ground plane PM1, preferably electrically connected to the latter at least near the main feed line LP1, and including electromagnetic coupling means fed orthogonally by a first end of the main feed line LP1. In the present context the expression "fed orthogonally" means that the electric field arrives in a plane perpendicular to the second ground plane PM2.

The second ground plane PM2 is preferably formed by metallizing the "lower" face of a "buffer" substrate SBT (indicated in certain figures by its ground plane PM2). Similarly, the first ground plane PM1 is preferably formed by metallizing the "front" face of a buffer substrate (not shown in the figures and represented by its ground plane PM1).

In this first embodiment, the electromagnetic coupling means are implemented in the form of a coplanar auxiliary feed line LA formed on the "upper" face of the second ground plane PM2 or on its lower face if it is metallized, as shown in FIG. 1 in particular, and extending (without any discontinuity) the main feed line LP1 to a connecting area Z.

Finally, the device D comprises a resonating structure SR disposed on the upper face of the second ground plane LP2, above and at the end of the auxiliary feed line LA. The resonant structure SR radiates energy at a selected operating wavelength $\lambda$ when it is excited by electromagnetic coupling to the first (upper) end of the main feed line LP1 via the coupling means LA of the second ground plane PM2.

The resonant structure SR may be a rectangular or circular patch, a massive dielectric resonator, for example taking the form, as shown here, of a rectangular parallelepiped with selected dimensions, or an air resonator implemented in the form of a rectangular parallelepiped $\lambda/4$ thick in the Z direction, for example. Remember that an air (or cavity) resonator is defined by the (second) ground plane (PM2), a top wall of dielectric material and lateral walls (in the Z direction) of dielectric material $\lambda/4$ thick, so that the fields can be contained in a non-dissipative medium. The thickness constraint results from opposed coefficients at the air/dielectric and dielectric/air interfaces that are rendered coherent by a thickness of $\lambda/4$.

In this first embodiment, the resonant structure SR is coupled to the auxiliary feed line LA by a proximity effect.

As shown in FIG. 2, for example, firstly, the first ground plane PM1 and the second ground plane PM2 are formed on alumina substrates approximately 0.635 mm thick having a permittivity $\in_r$ equal to about 9.9, secondly, the central conductors of the main feed line LP1 and the auxiliary line LA have a width $W_C$ equal to about 0.5 mm, thirdly, the slots on respective opposite sides of the central conductors of the main feed line LP1 and the auxiliary line LA have a width $G_S$ equal to about 0.23 mm, and, fourthly, the thickness e of ground plane eliminated at the end of the central conductors is about 0.23 mm. This embodiment offers a characteristic impedance of about 50Ω and achieves a bandwidth greater than 50% at 12.25 GHz for the $S_{11}$ mode at the transition between the orthogonal lines (LP1 and LA). Remember that, in the presence of an auxiliary line LA formed on the upper face of the radiating ground plane PM2, a slot must be formed in the line coupling area Z, which generates a radiating discontinuity and limits the bandwidth of the transition.

An alternative solution may be envisaged requiring no slot extending the auxiliary feed line LA over a chosen distance beyond the connecting area Z, in order to constitute a coplanar impedance adapter (also known as a "coplanar stub"). In this case, the extension is preferably over a length equal to λ/4. If the dimensions given above are used, for example, and a stub length is chosen equal to around 2.2 mm, a bandwidth of about 68% at 12.25 GHz may be achieved for the $S_{11}$ mode.

FIG. 3 shows the surface fields Ψ1 and Ψ2 that propagate in antiparallel fashion in the two lateral slots of the main feed line LP1 and in the auxiliary feed line LA.

A second embodiment of a radiating device D of the invention, also suitable for monopolarization, is described next with reference to FIGS. 4 to 9.

This second embodiment differs from the first in terms of the coupling means formed on the second ground plane PM2. In this embodiment, as in all the others to be described hereinafter, the coupling means are implemented in the form of a coupling slot that is preferably at the center of the resonant structure SR to obtain maximum coupling and minimize higher modes in said radiating structure SR and consequently crossed polarization radiation. For reasons of compactness, it is possible to fold the coupling slot or to give it special shapes, for example a "T-bar" shape.

Figure 5:
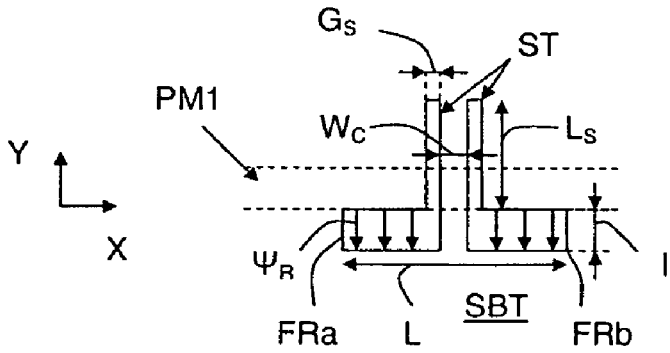
FIG. 5 is a plan view in the XY plane of a portion of the FIG. 4 radiating device.
Figure 6:
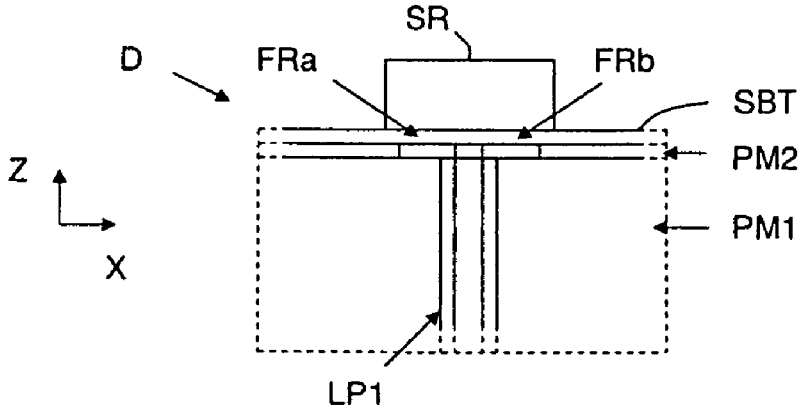
FIG. 6 is a front view in the XZ plane of a portion of the FIG. 4 radiating device.

To be more precise, in this embodiment, as shown in FIGS. 4 to 6, the coupling slot FR is of generally rectangular shape but is interrupted in its central portion by a portion of the second ground plane. In other words, the coupling slot FR has two portions FRa and FRb.

Here the longer sides of the coupling slot FR, called the longitudinal sides, extend in the X (longitudinal) direction and its shorter sides, called the transverse sides, extend in the Y (transverse) direction. The first ground plane being disposed in the XZ plane, the upper end of its main feed line LP1 therefore opens parallel to one of the longitudinal sides.

This embodiment corresponds to inductive coupling between the upper end of the main feed line LP1 and the resonant structure SR.

The upper end of the main feed line LP1 can open at the level of the coupling slot FR, but this is not the optimum. It is therefore preferable for each portion FRa and FRb of the coupling slot to be extended by an impedance adapter (stub) ST, as shown in FIGS. 4 and 5. The two stubs ST are rectangular slots that extend perpendicularly one of the longitudinal sides of the portions FRa and FRb of the coupling slot. The extension is preferably over a length of λ/4. In the presence of the stubs ST, the first ground plane PM1 is positioned so that the upper end of its main feed line LP1 is below the stubs ST, at the level of portions thereof providing the connection to the longitudinal side of the coupling slot FR.

The distance between the two portions FRa and FRb of the coupling slot, which is the same as the distance $W_C$ between the two stubs ST, which is itself equal to the width of the central conductor of the main feed line LP1, is made equal to about 0.5 mm, for example. The width $G_S$ of the stubs ST, which is substantially equal to the width of the slots of the main feed line LP1, is made equal to about 0.23 mm, for example. The length $L_S$ of the subs ST in the transverse (Y) direction is made equal to about 2.2 mm, for example. The length L (in the longitudinal X direction) and the width I (in the transverse Y direction) of the coupling slot FR are respectively about 5.2 mm and about 0.4 mm. The above values yield a bandwidth of approximately 8% at 12.25 GHz for the $S_{11}$ mode in the case of inductive coupling. Greater bandwidths can be obtained by capacitive or dipolar electric coupling.

Note that the bandwidth may be increased if the length $L_S$ of the stubs ST is slightly increased because of resonance at the level of the coupling slot FR.

Figure 7:
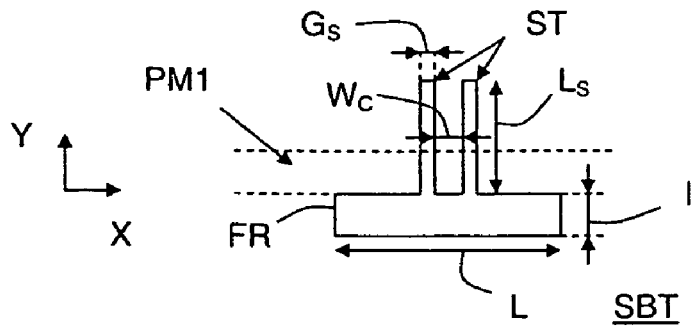
FIG. 7 is a plan view in the XY plane of a first variant of the FIG. 4 radiating device.
Figure 8:
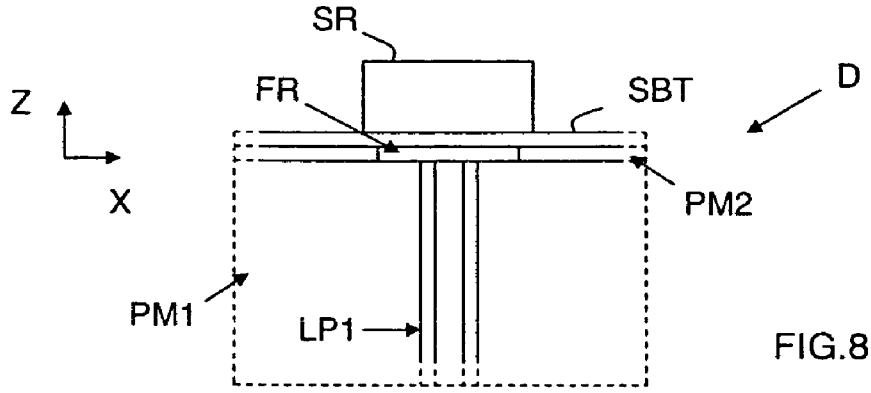
FIG. 8 is a front view in the XZ plane of a portion of the FIG. 7 radiating device.

FIGS. 7 and 8 show a first variant of the second embodiment described above with reference to FIGS. 4 to 6. In this first variant, the coupling between the upper end of the main feed line LP1 and the resonant structure SR is no longer inductive, but capacitive, by virtue of the fact that the central portion of the coupling slot FR is no longer interrupted by a portion of the second ground plane PM2.

Figure 9:
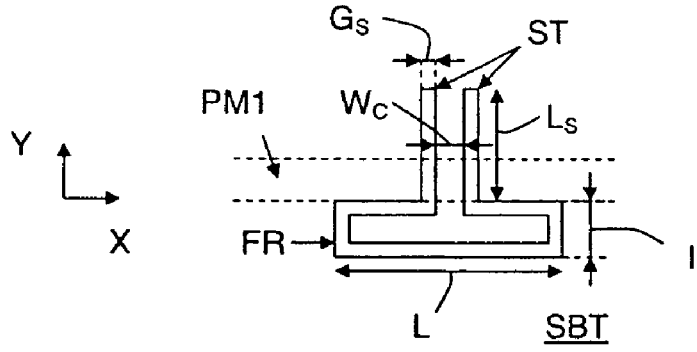
FIG. 9 is a plan view in the XY plane of a second variant of the FIG. 4 radiating device.

FIG. 9 shows a second variant of the second embodiment described above with reference to FIGS. 4 to 6. In this second variant the coupling between the upper end of the main feed line LP1 and the resonant structure SR is no longer inductive, being of the dipolar electric (or "T match") type because the conductive portion of the second ground plane remains present in the major portion of the coupling slot (FR). Alternatively, a flared dipole may be used. A coupling slot may also be used whose width is not equal to $G_S$ and therefore constitutes an additional adaptation parameter.

Figure 10:
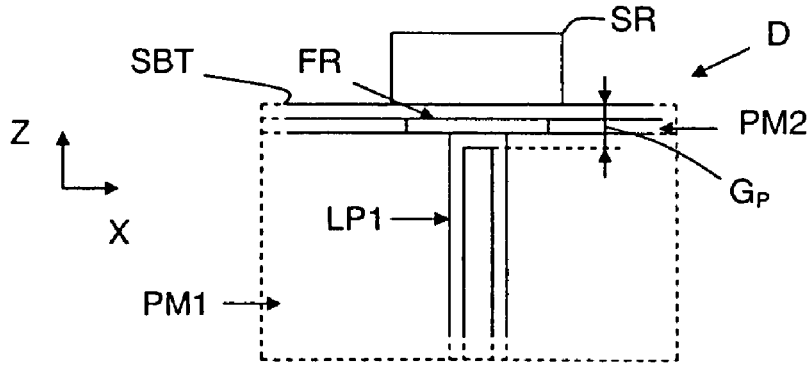
FIG. 10 is a front view in the XZ plane of a third embodiment of a radiating device of the invention.

FIG. 10 represents a third embodiment of the radiating device D of the invention. In this third embodiment, which constitutes a variant of the first variant using capacitive coupling shown in FIG. 8, the distance $G_P$ between the resonant structure SR and the end portion of the central conductor of the main feed line LP1 is increased. To achieve this, the central conductor of the main feed line LP1 is interrupted at a selected distance from the second ground plane PM2. The resulting capacitive coupling compensates the inductive coupling of the coupling slot FR. This means that the impedance may be adapted and the bandwidth significantly increased without using a stub.

A buffer substrate SBT made of Duroïd™ 5880 having a permittivity $\in_1$ equal to about 2.2 may be used, for example.

Figure 11:
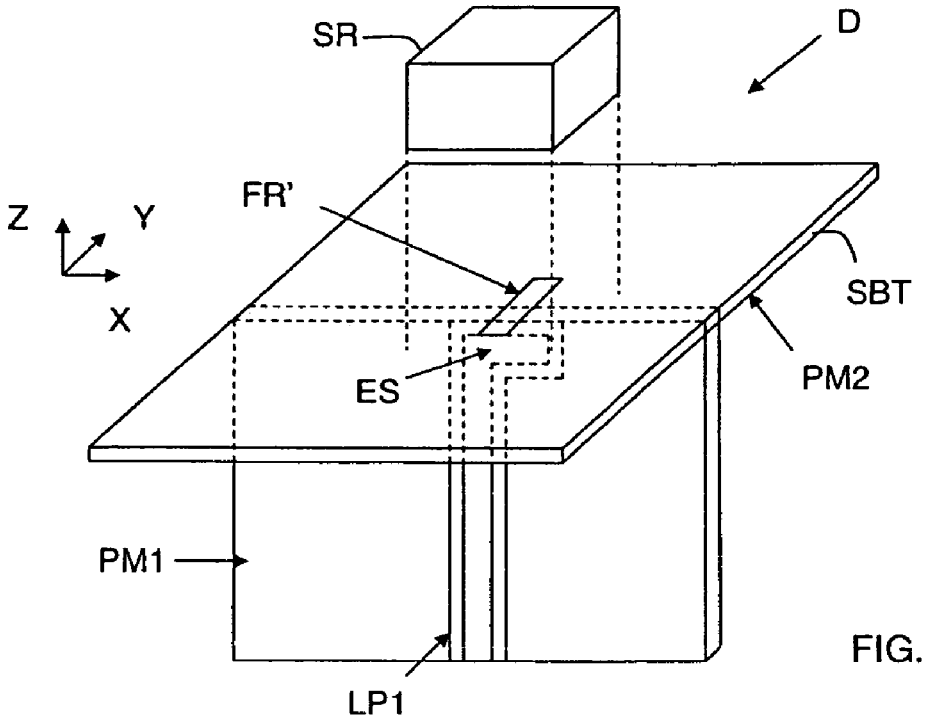
FIG. 11 is a diagram of a fourth embodiment of a radiating device as claimed in the invention.

A fourth embodiment of a radiating device D of the invention, also suitable for monopolarization, is described next with reference to FIG. 11.

In this fourth embodiment, the first ground plane PM1 still comprises a coplanar main feed line LP1. However, here, firstly, the coupling slot FR' has a rectangular general shape defined by a longitudinal Y direction (longer side) and a transverse X direction (shorter side), and, secondly, the upper end (ES) of the main feed line LP1 is bent at substantially 90° to place it under the coupling slot FR' parallel to the transverse X direction.

Figure 12:
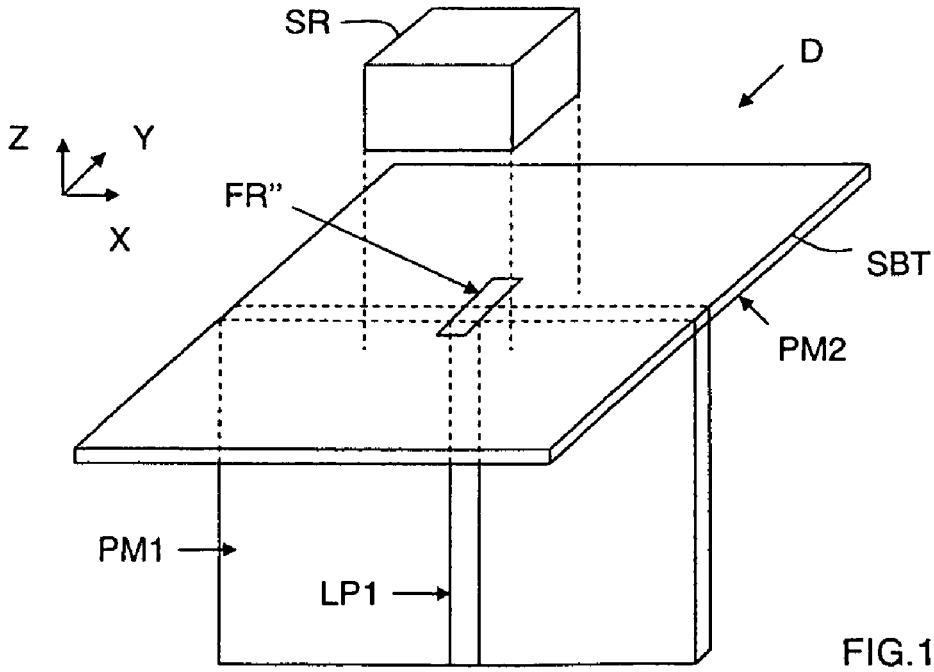
FIG. 12 is a diagram of a fifth embodiment of a radiating device as claimed in the invention.

A fifth embodiment of a radiating device D of the invention, also suitable for monopolarization, is described next with reference to FIGS. 12 and 13.

This fifth embodiment differs from the first four (FIGS. 1 to 11) in that its main feed line LP1 is of the "slotted" type. However, as in the second to fourth embodiments (FIGS. 4 to 11), the coupling means of the second ground plane PM2 take the form of a coupling slot FR" that is preferably rectangular.

The coupling slot FR" has longer (longitudinal) sides parallel to the longitudinal Y direction and shorter (transverse) sides parallel to the (transverse) X direction. The upper end of the main feed line LP1 is placed under the coupling slot FR", parallel to the transverse X direction and preferably in the middle of the slot FR" (as shown).

Figure 13:
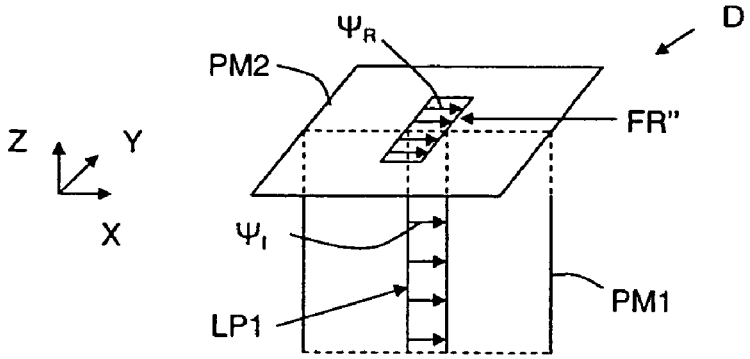
FIG. 13 shows the propagation of electric fields within the FIG. 12 radiating device.

FIG. 13 represents the surface field $\Psi_I$ in the main feed line LP1 and the field $\Psi_R$ radiated by the coupling slot FR". This figure shows the very good coupling of the fields $\Psi_I$ and $\Psi_R$ in this embodiment.

For example, the first ground plane PM1 and the second ground plane PM2 may be formed on alumina substrates about 0.635 mm thick and having a permittivity $\in_r$ of about 9.9, the microslot of the main feed line LP1 can have a width $W_S$ of about 0.96 mm, the coupling slot FR" may have a length L and a width I of about 13 mm and about 0.96 mm, respectively, and the resonant structure may be a square-based dielectric resonator made from an Eccostock™ HIK500 ceramic having a permittivity $\in_r$ of about 9.7 at 5 GHz whose side length is about 16 mm and whose height d/2 is about 7.62 mm. An embodiment of this kind has a characteristic impedance of about 147 Ω.

Figure 14:
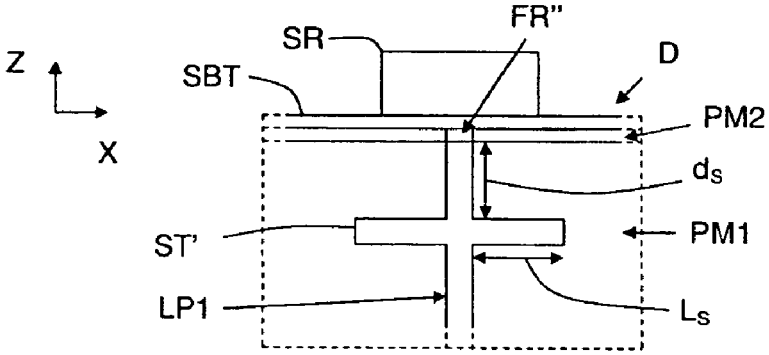
FIG. 14 is a front view in the XZ plane of a sixth embodiment of a radiating device of the invention.

An impedance adapter consisting of two stubs ST' may be added to the main feed line LP1 to increase the bandwidth compared to this fifth embodiment, as in a sixth embodiment shown in FIG. 14. Here, the two stubs ST' are slots (or microslots) communicating with the slot (or microslot) of the main feed line LP1, on respective opposite sides thereof, at the same selected distance from the end portion of its upper end.

The stubs ST' are preferably rectangular with their longer sides at least in part parallel to the X direction and their shorter sides parallel to the Z direction (which is vertical here), for example.

The stubs ST' may have a length of about 17 mm and be at a distance from the coupling slot FR" of $d_s$ of about 2.1 mm, for example. Using the values given above with reference to the fifth embodiment (FIGS. 12 and 13), a bandwidth of about 17% at 5 GHz may be achieved for the $S_{11}$ mode.

Figure 15:
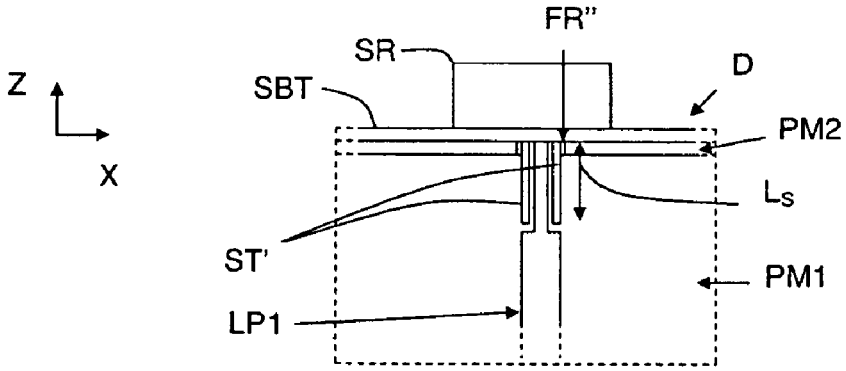
FIG. 15 is a front view in the XZ plane of a variant of the FIG. 14 radiating device.

As shown in the FIG. 15 variant, the stubs ST may be bent or folded parallel to the slot of the slotted line LP1. The stubs may equally well be defined inside the slotted line LP1, preferably at the junction with the coupling slot FR", in the form of L-shaped metal inserts connected to the ground plane PM1.

It is advantageous to provide a transition TR on the first ground plane PM1 to enable the main feed line comprising the slot LP1, which has no conductive portion, unlike a coplanar line, to be coupled to an active equipment (for example an MMIC) or a passive equipment (for example a connector).

Figure 16:
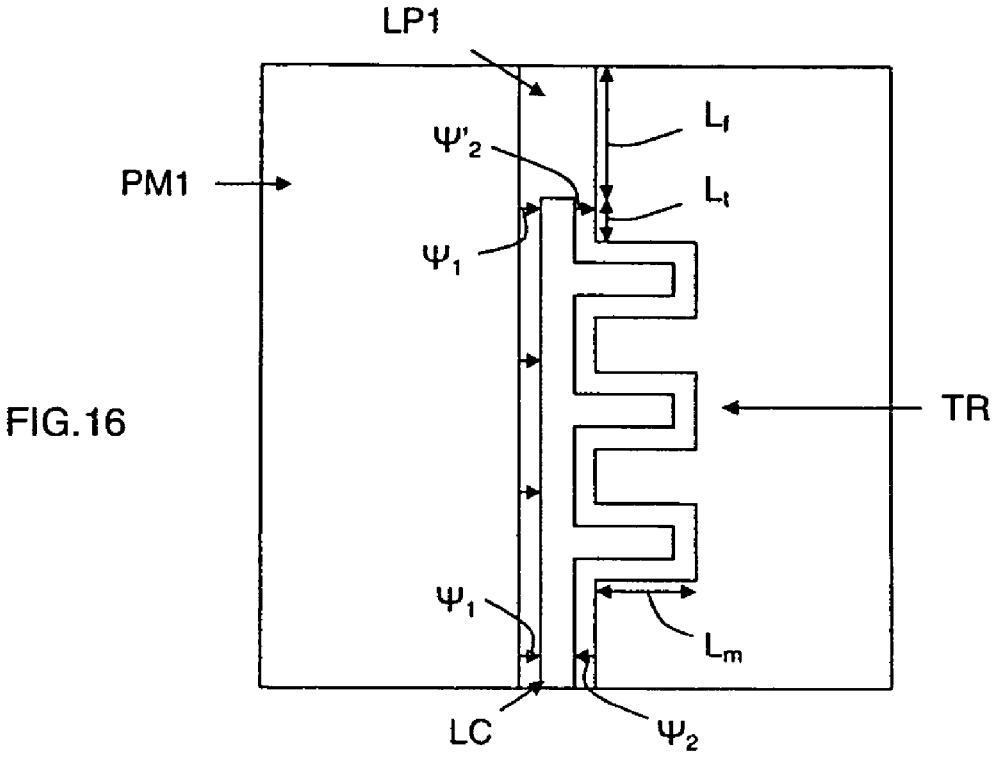
FIG. 16 is a diagram of a transition between a coplanar connection line and a slotted feed line suitable for the FIG. 14 device.

FIG. 16 shows a transition TR of this kind used to couple the slotted main feed line LP1 to a connecting line LC, which is preferably a coplanar line. A coplanar connecting line is preferable because it is implemented in a uniplanar technology like the slotted main feed line and facilitates the connection to certain equipments such as MMICs.

The transition TR converts one of the two antiparallel surface fields Ψ1 (even mode) and Ψ2 (odd mode) that propagate in the microslots situated on respective opposite sides of the central conductor of the coplanar connecting line LC into a surface field Ψ2' (even mode) identical to the other surface field Ψ1 and therefore to that propagating in the slot of the slotted main feed line LP1.

In this way a phase-shift of 180° is applied to one of the two slots of the coplanar connecting line LC so that their fields Ψ1 and Ψ2 are in phase, allowing the two slots to be combined to constitute the slot of the slotted main feed line LP1. Here the transition comprises three meanders having a length $L_m$ in the X direction equal to about 3.2 mm, for example. For optimum coupling, the length $L_C$ of the conductor at the output of the transition TR must be optimized. The length $L_C$ is made equal to about 0.25 mm, for example.

Air bridges are preferably introduced along the coplanar connecting line LC to block evolution of the reflection of the even mode Ψ1, with no phase shift, so that it is substantially independent of the length of the coplanar connecting line LC.

A bandwidth of about 40% at 5 GHz can be obtained at the level of the transition TR for the $S_{11}$ mode using a width $W_S$ of the slot of the main feed line LP1 of about 0.96 mm, a length of the main feed line LP1 of about 0.5 mm, a width $W_C$ of the central conductor for the coplanar connecting line LC of about 0.5 mm, a width $G_S$ of about 0.23 mm for the slots on respective opposite sides of the central conductor of the coplanar connecting line LC, and values of $L_m$ and $L_C$ of about 3.2 mm and about 0.25 mm, respectively.

Figure 17:
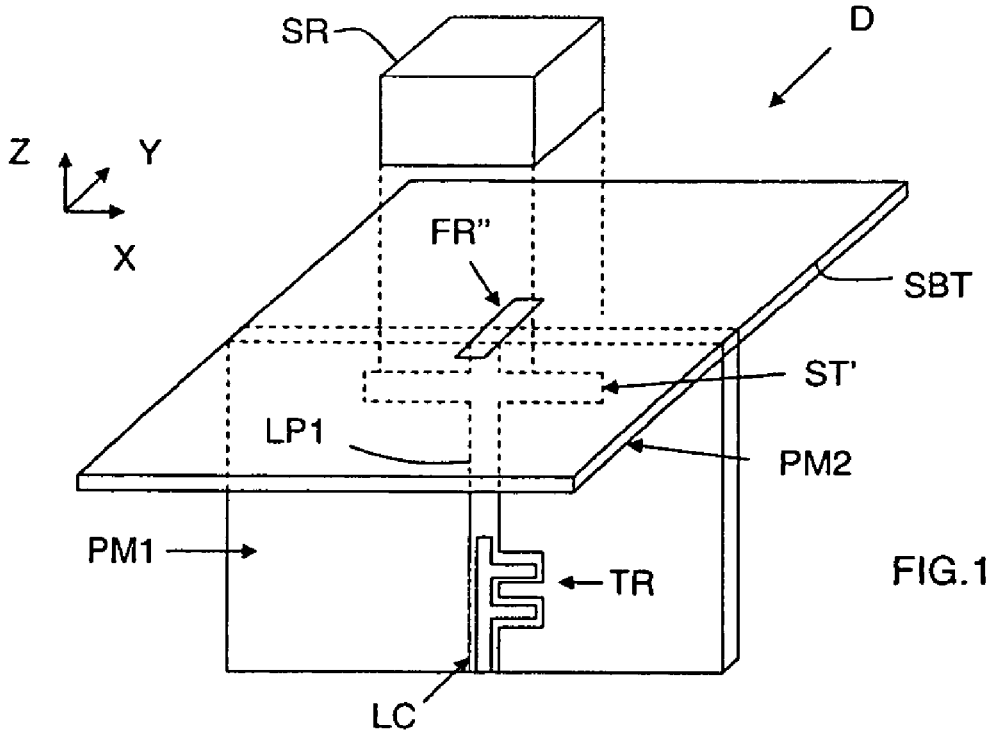
FIG. 17 is a diagram of a variant of the FIG. 14 radiating device incorporating a transition of the type shown in FIG. 16.

FIG. 17 shows a variant of the FIG. 14 radiating device D incorporating a transition TR of the type described above with reference to FIG. 16. As a result, a bandwidth of about 14% at 5 GHz can be attained for the $S_{11}$ mode using the values given above.

Figure 18:
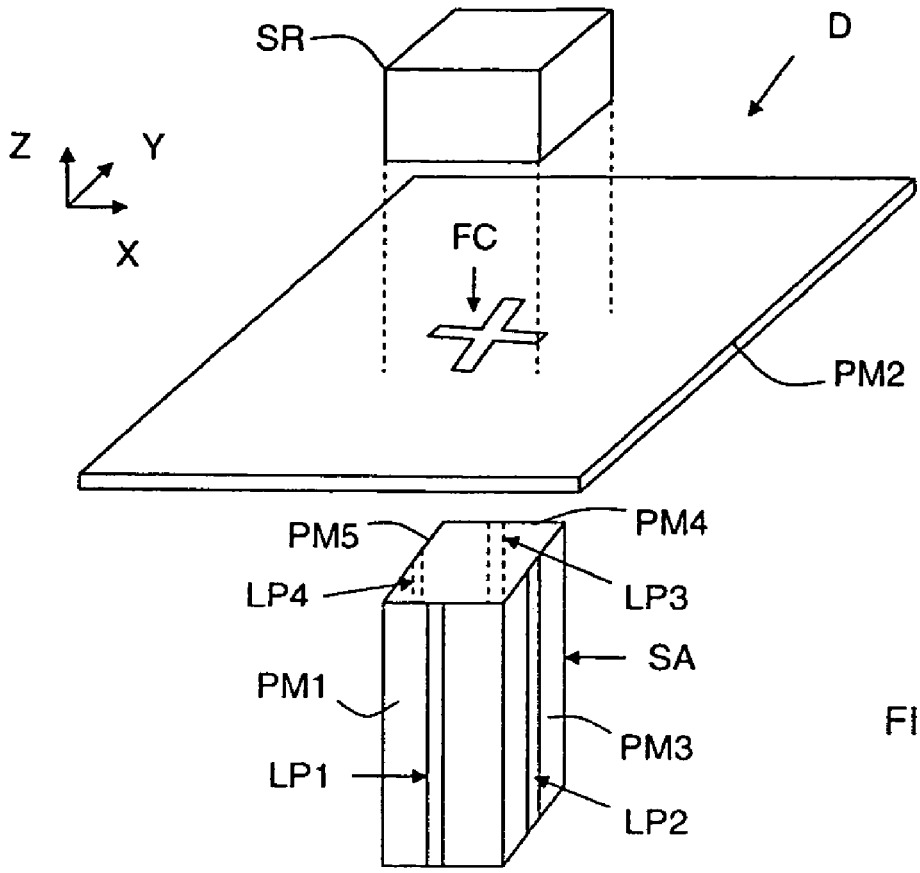
FIG. 18 is a diagram of a seventh embodiment of a radiating device of the invention.

A sixth embodiment of a radiating device D of the invention suitable for multipolarization, to be more specific for double linear polarization, is described next with reference to FIGS. 18 to 20.

In this sixth embodiment, the coupling means take the form of a cruciform coupling slot FC. A first branch B1 of the cross FC is placed in the Y direction and a second branch B2 perpendicular to the first branch B1 is placed in the X direction.

Each linear polarization is excited by one of the two branches B1 and B2 of the coupling slot FC, whose respective opposite ends are coupled to two main feed lines LP1 and LP3, on the one hand, and LP2 and LP4, on the other hand.

The four main feed lines LP1 to LP4 are respectively formed on four ground planes PM1, PM3, PM4 and PM5 that are perpendicular in pairs and are fastened together to constitute a cylindrical feed structure SA of square cross section.

Figure 19:
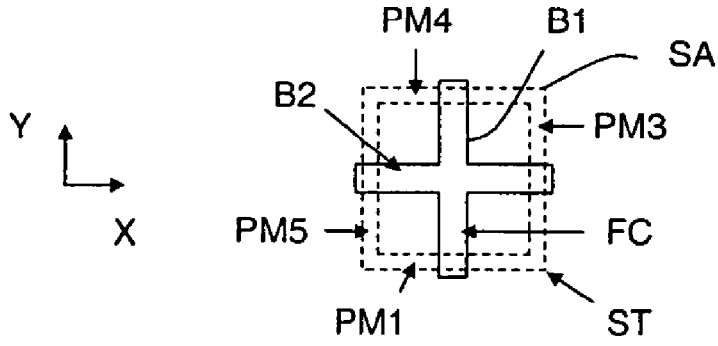
FIG. 19 is a plan view in the XY plane of the cruciform slot of the FIG. 18 radiating device.
Figure 20:
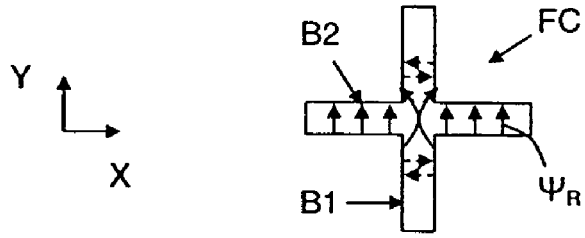
FIG. 20 is a plan view in the XY plane of the cruciform slot of the FIG. 18 radiating device showing the electric field.

To be more precise, as shown in FIG. 19, the "front" end of the first branch B1 is coupled to the upper end of the main feed line LP1 situated on the first ground plane PM1, the "rear" end of the first branch B1 is coupled to the upper end of the main feed line LP3 situated on the fourth ground plane PM4, the "right-hand" end of the second branch B2 is coupled to the upper end of the main feed line LP2 situated on the third ground plane PM3, and the "left-hand" end of the second branch B2 is coupled to the upper end of the main feed line LP4 situated on the fifth ground plane PM5.

In this embodiment, the four main feed lines LP1 to LP4 are slotted. Consequently, each line is parallel to the transverse sides of the branch B1 or B2 to which it is coupled.

Because of the perfect axial symmetry obtained for each polarization, it is possible to obtain a very high level of isolation between the two linear polarizations. As shown in FIG. 20, feeding the electric field via two points situated at the two ends of one of the branches B1 and B2 forcibly cancels the electric field in the other branch.

A seventh embodiment of a radiating device D of the invention also suitable for multipolarization, and to be more precise for double linear polarization, is described next with reference to FIGS. 21 to 23.

In this seventh embodiment the coupling means take the form of a coupling slot FD having the shape of the pound symbol (#). As shown in FIG. 22, the first branch B1 and the third branch B3 of the pound symbol are offset and parallel to the X direction and the second branch B2 and the fourth branch B4 are perpendicular to the branches B1 and B3 and offset and parallel to the Y direction. It may be noted that the slot may also have a square shape, which is a particular instance of the shape of the pound symbol.

The parallel branches excite the same polarization. Each branch B1 to B4 is coupled by a middle portion to the upper end of a main feed line LP11, LP12, LP21 or LP22.

The four main feed lines LP11, LP12, LP21 and LP22 are formed in pairs on two mutually perpendicular ground planes PM1 and PM3.

Figure 21:
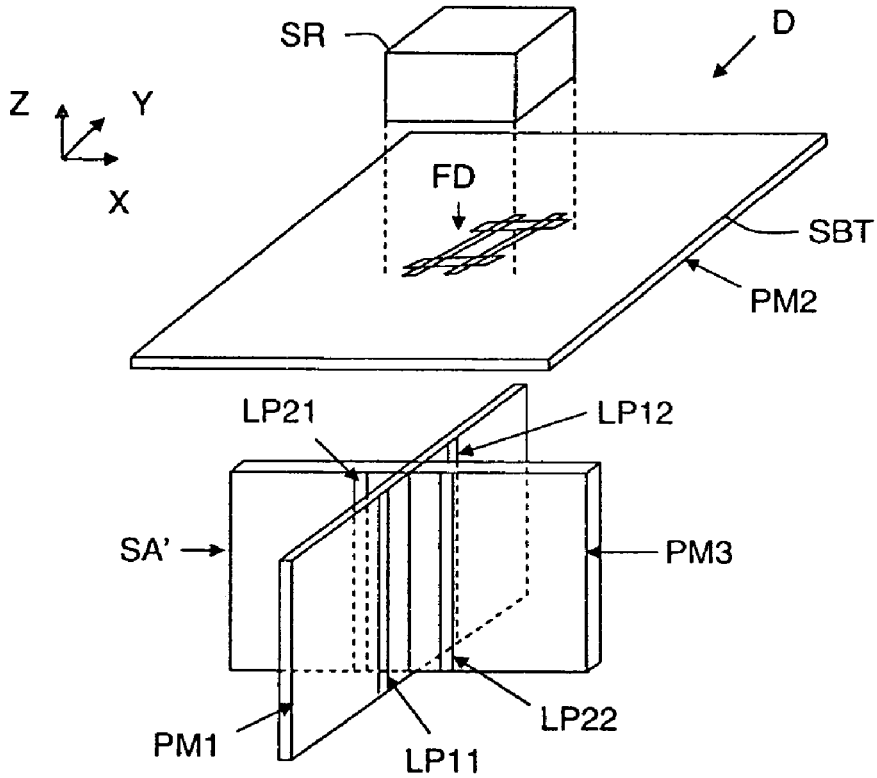
FIG. 21 is a diagram of an eighth embodiment of a radiating device of the invention.

To be more precise, as shown in FIG. 21, the center of the first branch B1 is coupled to the upper end of the main feed line LP11 situated on the first ground plane PM1, the center of the third branch B3 is coupled to the upper end of the main feed line LP12 situated on the first ground plane PM1 at a distance from LP11 equal to the distance between B1 and B3, the center of the second branch B2 is coupled to the upper end of the main feed line LP22 situated on the third ground plane PM3, and the center of the fourth branch B4 is coupled to the upper end of the main feed line LP21 situated on the third ground plane PM3 at a distance from LP22 equal to the distance between B2 and B4.

The first ground plane PM1 and the third ground plane PM3 therefore define a cruciform feed structure SA'.

In this embodiment the four main feed lines LP11, LP12, LP21 and LP22 are slotted. Consequently, each line is parallel to the transverse sides of the branch B1, B2, B3 or B4 to which it is coupled.

Figure 23:
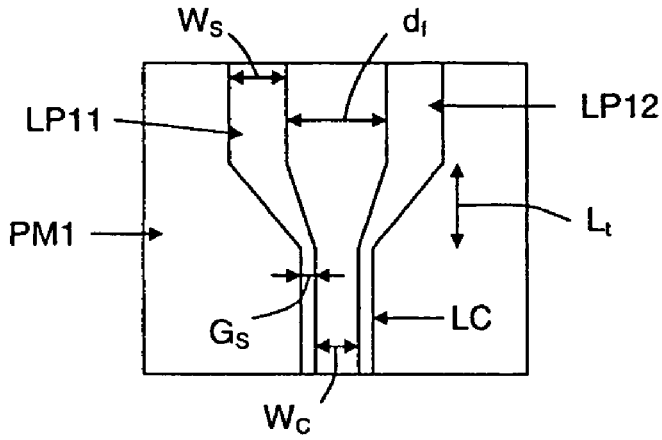
FIG. 23 is a front view in the XZ plane of a variant feed for the FIG. 21 radiating device.
Figure 24:
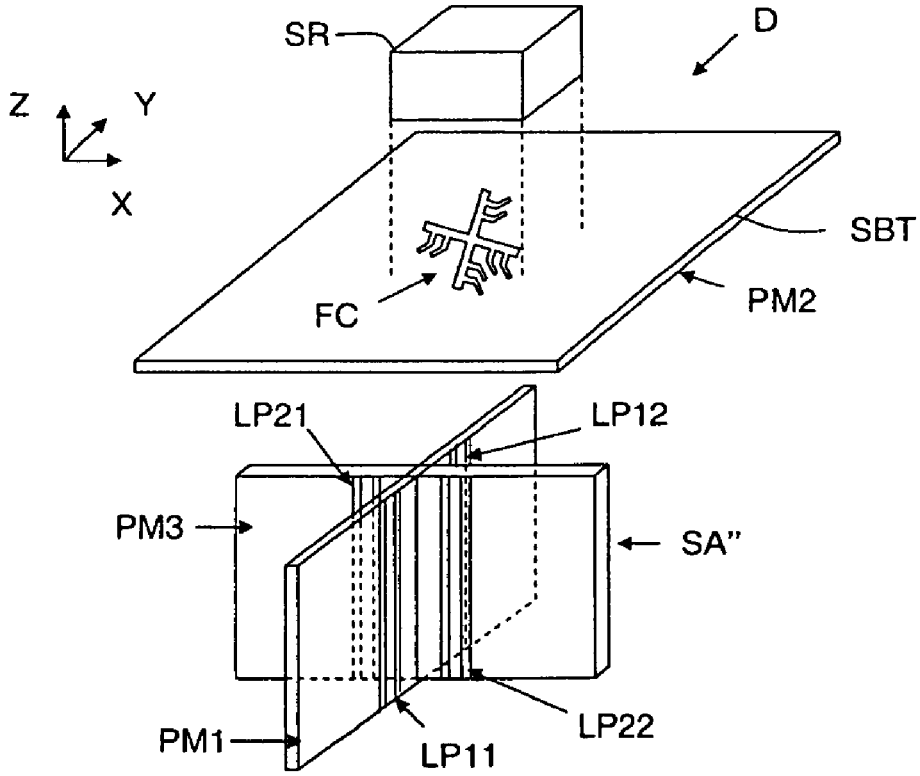
FIG. 24 is a diagram of a ninth embodiment of a radiating device of the invention.

FIG. 23 shows a particularly advantageous embodiment of the two main feed lines on the ground planes PM1 and PM3. This embodiment uses a coplanar connecting line LC to define the two main feed lines on a ground plane. To this end, each slot (or microslot) on one side of the central conductor of the coplanar connecting line LC has a linear first portion of width $G_S$ and a second, transition portion that is misaligned relative to the first portion and has a width increasing from a value $G_S$ to a value $W_S$ equal to the width of a slot of the main feed line LP11. The second portions extend over a selected height $L_t$. The distance between the two slots of the coplanar connecting line LC is therefore constant and equal to $W_C$ at the level of the first portions and increases to a value of equal to the distance between the branches B1 and B3 or B2 and B4 of the coupling slot FD in the shape of the pound symbol at the level of the second portions.

The two main feed lines LP11 and LP12 or LP21 and LP22 of the first ground plane PM1 or the third ground plane PM3 therefore begin at the exit from the second portions of the slots of the coplanar connecting line LC, where the width of the central conductor is $d_f$. The two main feed lines LP11 and LP12 or LP21 and LP22 that extend the second, transition portions are parallel to the first portions and have a constant width $W_S$.

For example, $G_S$ may be about 0.23 mm, $W_S$ about 0.96 mm, $W_C$ about 0.5 mm, $d_f$ about 12 mm and $L_t$ about 8 mm.

It is important to note that in this embodiment the surface fields that propagate in the two main feed lines on the same ground plane have a phase difference of 180° because they are fed by the antiparallel surface fields Ψ1 and Ψ2 of the coplanar connecting line LC. Consequently, one of the two main feed lines must be coupled to a 180° phase-shifter before coupling its upper end to the branch concerned of the coupling slot FD in the shape of the pound symbol. This phase-shift may be applied by means of an additional length of line, for example.

An eighth embodiment of a radiating device D of the invention also suitable for multipolarization, and to be more precise for double linear polarization, is described next with reference to FIGS. 24 to 27.

In this eighth embodiment, the coupling means again take the form of a cruciform coupling slot FC'. A first branch B1 of the cross FC' is placed in the Y direction and a second branch B2 perpendicular to B1 is placed in the X direction.

As in the sixth embodiment (FIGS. 18 to 20), each linear polarization is excited by one of the two branches B1 and B2 of the coupling slot FC', whose respective opposite ends are coupled to two main feed lines LP11 and LP12, on the one hand, and LP21 and LP22, on the other hand.

Figure 22:
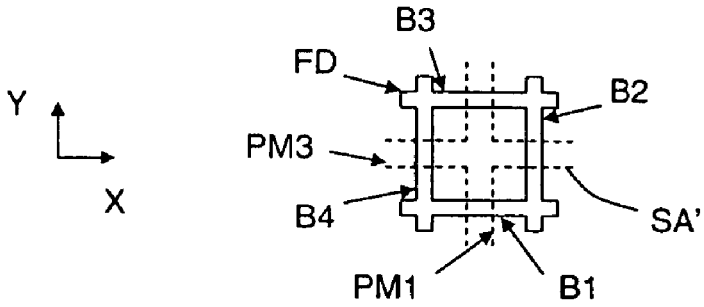
FIG. 22 is a plan view in the XY plane of the slot of the FIG. 21 radiating device, which is the shape of the pound symbol (#)

The four main feed lines LP11, LP12, LP21 and LP22 are formed in pairs on two ground planes PM1 and PM3 that are mutually perpendicular, as in the seventh embodiment (FIGS. 21 to 23).

The first ground plane PM1 and the third ground plane PM3 thus form a cruciform feed structure SA".

In this embodiment, the four main feed lines LP11, LP12, LP21 and LP22 are coplanar. Consequently, as shown in FIG. 25, each line is parallel to one of the longitudinal sides of the branch B1 or B2 to which it is coupled.

Figure 25:
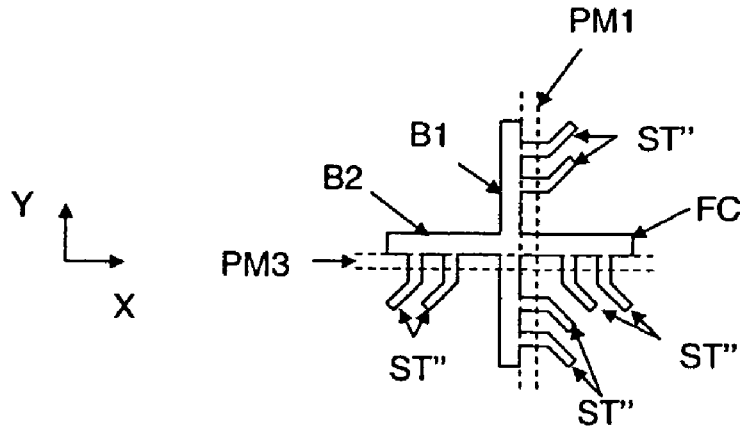
FIG. 25 is a plan view in the XY plane of the cruciform slot of the FIG. 24 radiating device.

As shown in FIG. 25, the two opposite ends of each branch B1, B2 are preferably provided on one of their longitudinal sides with a pair of impedance adaptation slots (stubs) ST".

The stubs ST" have the function described above with reference to FIGS. 5, 7 and 9. However, they differ from those described hereinabove in that they have a bent shape, for reasons of overall size. To be more precise, each stub ST" has a connecting portion perpendicular to the longitudinal side of the branch concerned and extended by an oblique end portion.

Figure 26:
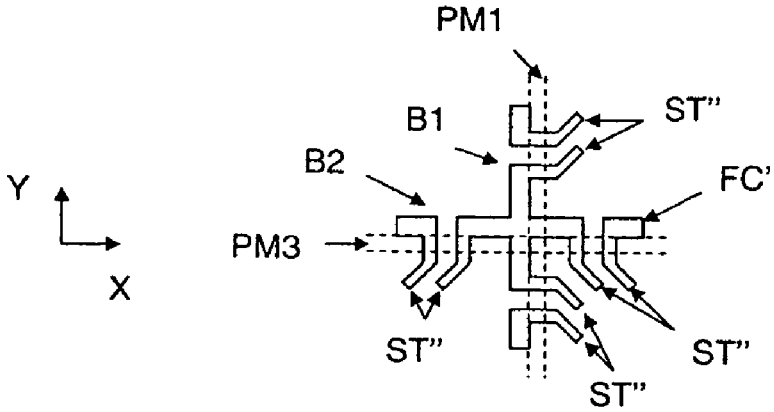
FIG. 26 is a plan view in the XY plane of a first variant of the cruciform slot of the FIG. 24 radiating device.
Figure 27:
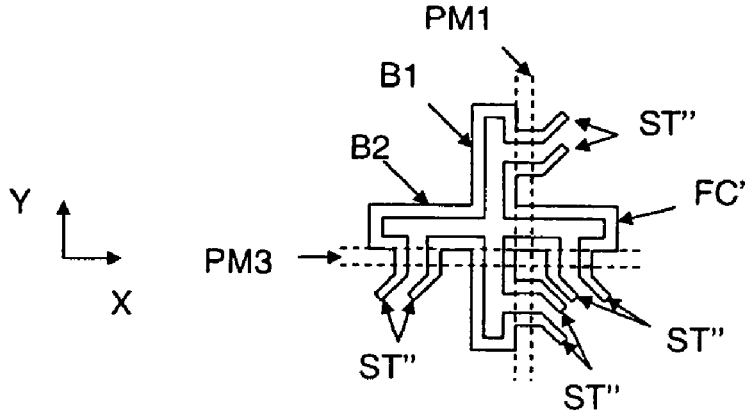
FIG. 27 is a plan view in the XY plane of a second variant of the cruciform slot of the FIG. 24 radiating device.

The cruciform slot FC' of FIG. 25 provides capacitive coupling. Nevertheless, variants with two cruciform slots FC' may be envisaged that are respectively suitable for inductive coupling and dipolar electric coupling, as shown in FIGS. 26 and 27. This latter embodiment is described in particular in a paper by D. Llorens Del Rio et al. entitled "The T match: an integrated match for CPW-fed slot antennas", JINA 2002, Vol. No. 2, pp. 347-350, under the name T-match.

In this eighth embodiment, the two ends of the first branch B1 are coupled via the pairs of stubs ST" to the upper ends of the main feed lines LP11 and LP12 on the first ground plane PM1 and the two ends of the second branch B2 are coupled via the pairs of stubs ST" to the upper ends of the main feed lines LP21 and LP22 on the third ground plane PM3.

Figure 28:
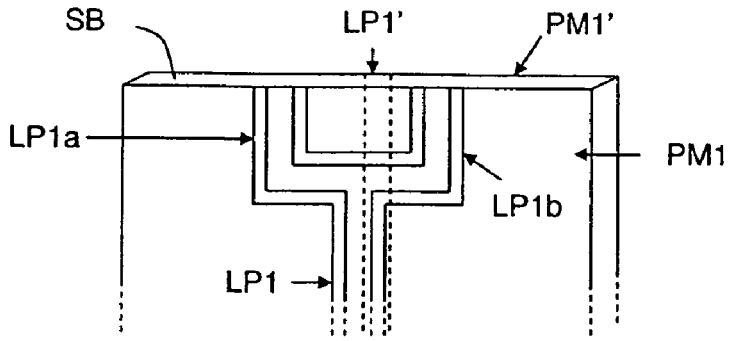
FIG. 28 is a perspective view of a substrate of a variant of a radiating device of the invention carrying two first ground planes.
Figure 29:
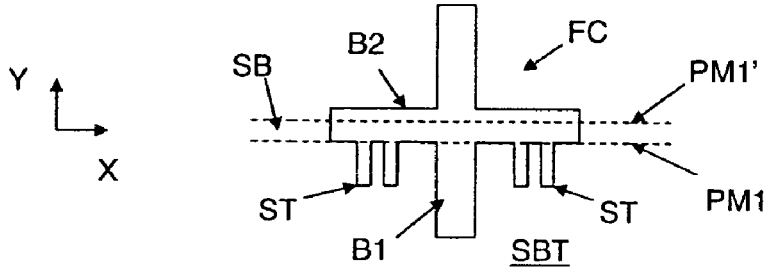
FIG. 29 is a plan view in the XY plane of a cruciform coupling slot variant suitable for the FIG. 28 substrate.

In another variant, shown in FIGS. 28 and 29, dual polarization may be achieved by means of a single orthogonal substrate SB containing two ground planes PM1 and PM1'. To this end a cruciform coupling slot FC may be used comprising stubs ST at the two ends of its branch B1. The excitation for one of the polarizations is effected using two coplanar main feed lines LP1*a* and LP1*b* in a first ground plane PM1 formed on the front face of a substrate SB. The excitation for the other orthogonal polarization is effected using a slotted main feed line LP1' in another first ground plane PM1' formed on the rear face of the substrate SB.

This exploits the fact that the coplanar lines LP1 and LP1*b* and the slotted line LP1' are adapted to excite orthogonal slots.

Figure 30:
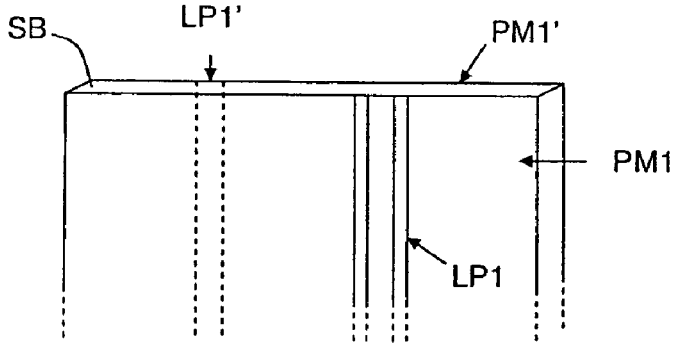
FIG. 30 is a perspective view of a substrate of another variant of a radiating device of the invention carrying two first ground planes.
Figure 31:
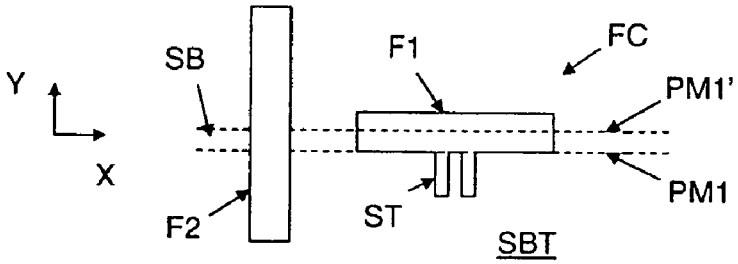
FIG. 31 is a plan view in the XY plane of a combination of two rectangular coupling slots suitable for the FIG. 30 substrate.

The orthogonal slots may be separated to obtain excitation by coplanar line and excitation by slotted line, as shown in FIGS. 30 and 31. To be more precise, this again produces dual polarization, again using a single orthogonal substrate SB containing two ground planes PM1 and PM1. Two rectangular coupling slots F1 and F2 may be used for this purpose. The slot F1 preferably has stubs ST in its central portion. Excitation is effected for one of the polarizations using a coplanar main feed line LP1 in a first ground plane PM1 formed on the front face of a substrate SB. Excitation is effected for the other (perpendicular) excitation using a slotted main feed line LP1' in another first ground plane PM1' formed on the rear face of the substrate SB.

This exploits the fact that the coplanar lines LP1*a* and LP1*b* and the slotted line LP1' are adapted to excite orthogonal slots. The orthogonal slots may be separated to obtain coplanar line excitation and slotted line excitation.

In another variant circular polarization can be obtained by using only one port. A resonant structure may be used for this purpose having, on a surface or within its structure, at least one electrically conductive parasitic element adapted to create or to reinforce an asymmetry of the resonant structure relative to the feed (or access) line. A structure of this kind is described in the patent document FR 2829300 in the name of the Centre National de la Recherche Scientifique (CNRS), for example.

Figure 32:
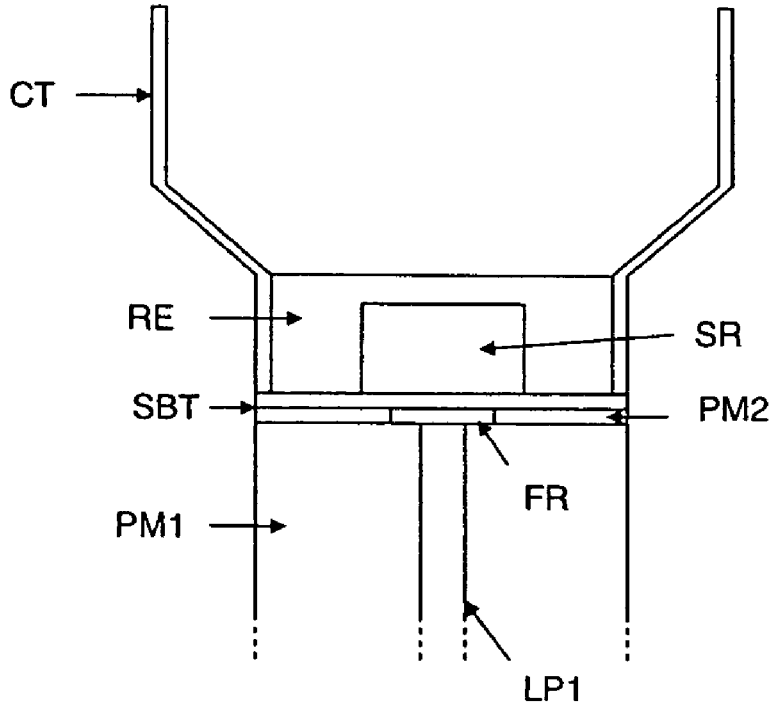
FIG. 32 shows a ninth embodiment of a radiating device of the invention in section in the XZ plane.

Resonant structures SR of the dielectric or air resonator type are described hereinabove. A variant resonant structure SR shown in FIG. 32 uses a notched dielectric "washer" RE placed at the back of a horn CT and providing the "negative" side of an air resonator SR (with no lateral wall $\lambda/4$ thick) with only one dielectric medium. The main feed line LP1 may be of the coplanar or slotted type.

To prevent excitation of higher modes in the horn CT, the latter may have a reduced cross section in the portion housing the dielectric washer RE, thus freeing up space for excitation with a plurality of ports at the periphery of the horn, if the latter is of the dual band type. The metallic lateral walls of the horn CT have a mirror effect and may be placed at a distance from the air resonator of $\lambda/8$ (or $3\lambda/8$, $5\lambda/8$, etc.).

Figure 33:
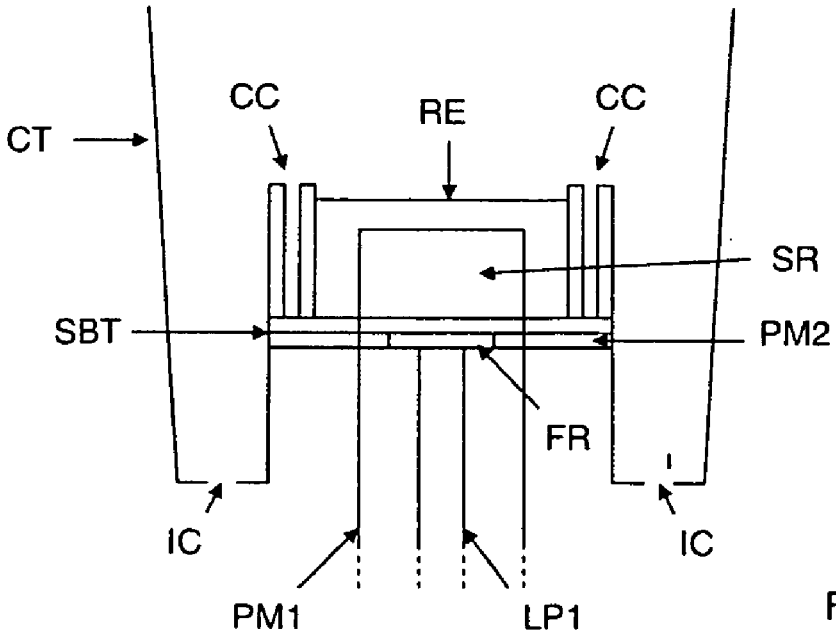
FIG. 33 shows a tenth embodiment of a radiating device of the invention in section in the XZ plane.
Figure 34:
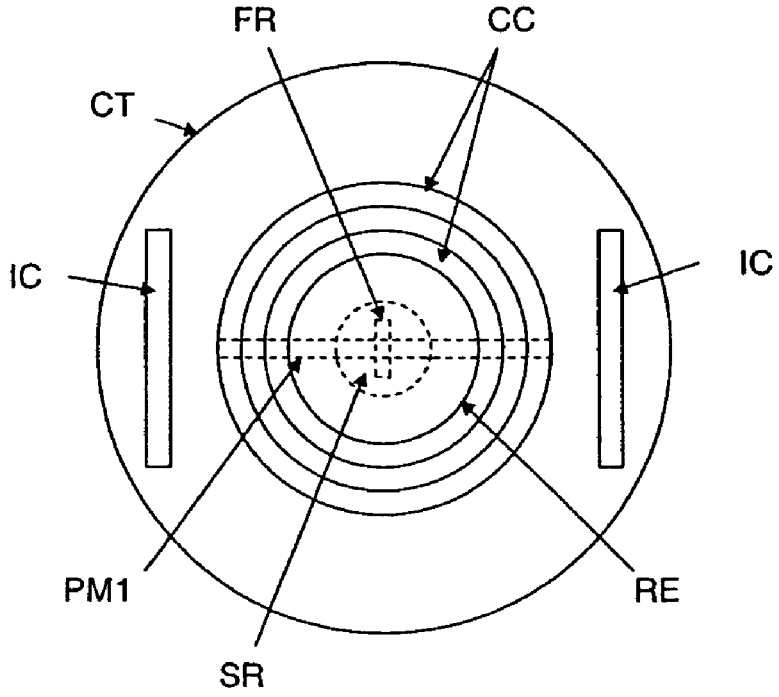
FIG. 34 is a plan view in the XY plane of the FIG. 33 radiating device.

This resonant structure variant may be used to feed a horn variant of the type shown in FIGS. 33 and 34. Here, the horn CT is semiconical and comprises, in a lower portion, two coupling irises IC, and, in an intermediate and central portion, a substrate SBT on whose lower face the second ground plane PM2 and a rectangular coupling slot FR are formed and which is attached by its upper face to concentric decoupling coils or chokes CC that house the cylindrical dielectric washer RE delimiting the air resonator SR. The main feed line LP1 may be of the coplanar or slotted type.

Two access ports at 0° and 180° are required for excitation in the low frequency band. For a high-power application, excitation is effected using waveguides. For an intermediate power application, the same type of excitation may be used as in the low-frequency band situation, where applicable with a complementary dielectric cap to force the mode to be established in the radiating structure.

Figure 35:
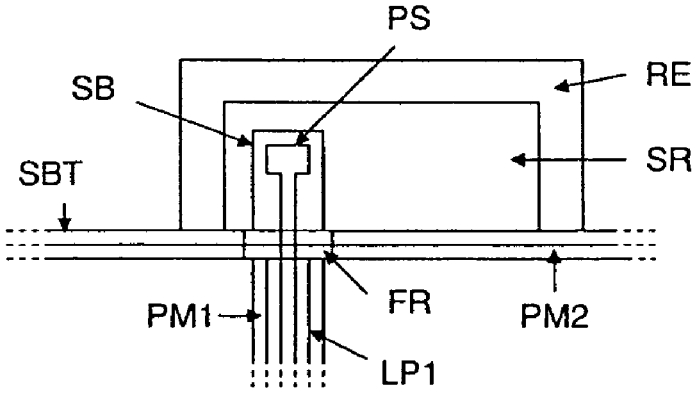
FIG. 35 shows an eleventh embodiment of a radiating device of the invention in section in the XZ plane.
Figure 36:
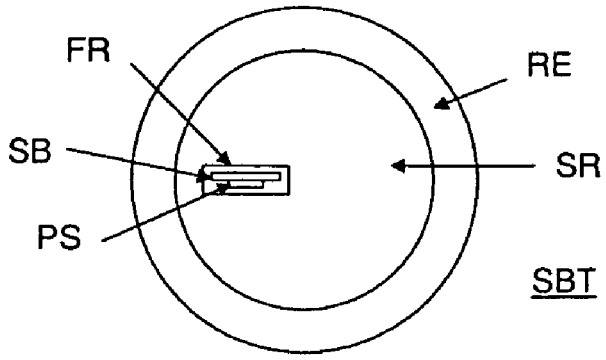
FIG. 36 is a plan view in the XY plane of the FIG. 35 radiating device, FIG. 37 schematically illustrates an array antenna.

Using an air resonator SR provides a further radiating device variant of the type shown in FIGS. 35 and 36. Here, the main feed line LP1 is coplanar. The substrate SB on which it is formed has a narrow extension crossing the second ground plane PM2 at the level of a slot FR and supporting an extension PS of the central conductor of the main feed line LP1. The coupling slot FR is preferably off-center relative to the air resonator SR and has small dimensions in order not to radiate.

Moreover, each radiating device D of the invention may be coupled to a horn for controlling the energy to be radiated so that it conforms to a selected template. In this case, the resonant structure SR is used as a compact exciter of the horn.

Figure 37:
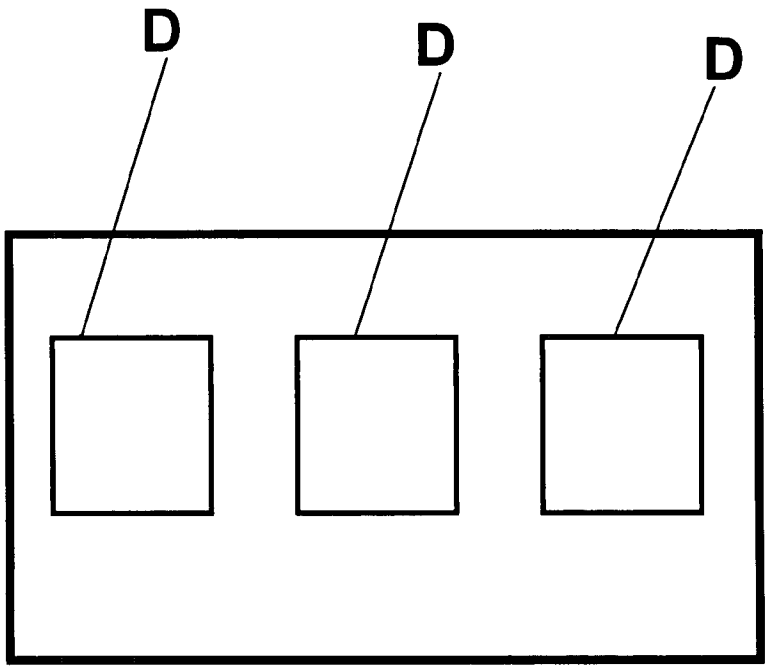

A plurality of radiating devices D of the type described above may be combined to constitute a portion of an antenna, possibly an array antenna, for example, as in FIG. 37. To this effect, the radiating devices D may be connected using the ALCATEL 3D technology developed for large scale integration microwave circuits. This 3D technology consists in using a standard low-loss resin to bury circuits on which are installed the electronic components defining the feed system SA, and etching the second ground plane PM2 (orthogonal to the first ground plane PM1) on the upper face of the resin.

The invention is not limited to the radiating device (or element) and antenna embodiments described above by way of example only, but encompasses all variants that the person skilled in the art might envisage that fall within the scope of the following claims.

The invention claimed is:

1. A radiating device for an antenna, comprising a first ground plane comprising a surface electric field main feed line, a second ground plane substantially perpendicular to said first ground plane and comprising electromagnetic coupling means fed orthogonally by a first end of said main feed line, and a resonant structure adapted to radiate energy at a selected wavelength in the event of excitation by electromagnetic coupling at the first end of said main feed line via said coupling means, wherein said coupling means comprise a coplanar auxiliary feed line substantially perpendicular to said main feed line and having a first end coupled to said first end of said main feed line and a second end coupled by a proximity effect to said resonant structure.

2. A radiating device for an antenna, comprising a first ground plane comprising a surface electric field main feed line, a second ground plane substantially perpendicular to said first ground plane and comprising electromagnetic coupling means fed orthogonally by a first end of said main feed line, and a resonant structure adapted to radiate energy at a selected wavelength in the event of excitation by electromagnetic coupling at the first end of said main feed line via said coupling means, wherein said coupling means comprise a coupling slot of selected shape adapted to couple said first end of said main feed line and said resonant structure.

3. A device as claimed in claim 2, wherein said resonant structure is selected from a group comprising a patch, a dielectric resonator and an air resonator whose thickness is equal to one quarter of said selected wavelength.

4. A device as claimed in claim 2, wherein said coupling slot has a rectangular general shape defined by a longitudinal direction and a transverse direction and said main feed line is of the slotted type and has a first end substantially parallel to said transverse direction and placed substantially in the middle of said coupling slot.

5. A device as claimed in claim 4, wherein said main feed line comprises a microslot impedance adapter at a selected distance from its first end.

6. A device as claimed in claim 4, wherein said first ground plane comprises a coplanar connecting line having a first end of selected shape and a second end in which propagate first and second antiparallel surface electric fields and said main feed line has a second end of selected shape adapted to cooperate with said first end of said connecting line to transform said second surface electric field into said first surface electric field adapted to excite said resonant structure.

7. A device as claimed in claim 2, wherein said coupling slot has a rectangular general shape defined by a longitudinal direction and a transverse direction and said main feed line is of the coplanar type and is substantially parallel to said longitudinal direction.

8. A device as claimed in claim 7, wherein said first end of said main feed line opens onto the middle of a longitudinal side of said coupling slot.

9. A device as claimed in claim 7, wherein said coupling slot has a longitudinal side extended perpendicularly, in the middle, by two adaptation microslots of selected dimensions, parallel to each other and spaced from each other by a selected distance, said first end of said main feed line opening substantially at the connection between said longitudinal side of said coupling slot and said adaptation microslots.

10. A device as claimed in claim 2, wherein said coupling slot has a rectangular general shape defined by a longitudinal direction and a transverse direction and said main feed line is of the coplanar type and has, in a middle portion of said coupling slot, a first bent end substantially parallel to its transverse direction.

11. A device as claimed in claim 2, wherein said coupling between said resonant structure and said coupling slot is selected from a group comprising inductive coupling, capacitive coupling and dipolar electric coupling.

12. An antenna comprising a radiating device as claimed in claim 2.

13. An antenna as claimed in claim 12 in the form of an array antenna.

14. The radiating device as claimed in claim 2, wherein the resonant structure is disposed on an upper major face of the second ground plane.

15. A radiating device for an antenna, comprising a first ground plane comprising a surface electric field main feed line, a second ground plane substantially perpendicular to said first ground plane and comprising electromagnetic coupling means fed orthogonally by a first end of said main feed line, and a resonant structure adapted to radiate energy at a selected wavelength in the event of excitation by electromagnetic coupling at the first end of said main feed line via said coupling means, further comprising a third ground plane substantially perpendicular to said first ground plane and said second ground plane and comprising at two selected locations two substantially parallel coplanar main feed lines and wherein said first ground plane comprises at two selected locations two substantially parallel coplanar main feed lines and said coupling means comprise a coupling slot having a cruciform general shape with a first branch and a second branch that are substantially perpendicular, said first branch having two opposite ends respectively coupled to said two main feed lines of the first ground plane and said second branch having two opposite ends respectively coupled to said two main feed lines of said third ground plane to provide double linear polarization.

16. A device as claimed in claim 15, wherein said first branch has a longitudinal side extended, at both ends, by two adaptation microslots of selected size and shape and having connecting portions substantially perpendicular to said longitudinal side and spaced by a selected distance, said first end of each main feed line of said first ground plane opening substantially at the connection between one of the ends of said longitudinal side of said first branch and said connecting portions of said adaptation microslots and said second branch has a longitudinal side extended, at both ends, by two adaptation microslots of selected size and shape and having connecting portions substantially perpendicular to said longitudinal side and spaced from each other by a selected distance, said first end of each main feed line of said third ground plane opening substantially at the connection between one of the ends of said longitudinal side of said second branch and said connecting portions of said adaptation microslots.

17. A device as claimed in claim 16, wherein each adaptation microslot has an end portion extending its connecting portion at a selected angle.

18. A radiating device for an antenna, comprising a first ground plane comprising a surface electric field main feed line, a second ground plane substantially perpendicular to said first ground plane and comprising electromagnetic coupling means fed orthogonally by a first end of said main feed line, and a resonant structure adapted to radiate energy at a selected wavelength in the event of excitation by electromagnetic coupling at the first end of said main feed line via said coupling means, further comprising a feed structure comprising four walls physically connected in pairs to define an open cylinder of square cross section, a first wall consisting of said first ground plane comprising a slotted main feed line, a second wall consisting of a third ground plane substantially perpendicular to said first ground plane and said second ground plane and comprising a slotted main feed line, a third wall consisting of a fourth ground plane substantially perpendicular to said second ground plane and said third ground plane and comprising a slotted main feed line, a fourth wall consisting of a fifth ground plane substantially perpendicular to said first ground plane, said second ground plane, and said fourth ground plane, and comprising a slotted main feed line, said coupling means comprise a coupling slot having a cruciform general shape with a first branch and a second branch that are substantially perpendicular, said first branch having two opposite ends respectively coupled to said main feed lines of said first ground plane and said fourth ground plane and said second branch having two opposite ends respectively coupled to said main feed lines of said third ground plane and said fifth ground plane to provide double linear polarization.

19. A radiating device for an antenna, comprising a first ground plane comprising a surface electric field main feed line, a second ground plane substantially perpendicular to said first ground plane and comprising electromagnetic coupling means fed orthogonally by a first end of said main feed line, and a resonant structure adapted to radiate energy at a selected wavelength in the event of excitation by electromagnetic coupling at the first end of said main feed line via said coupling means, further comprising a third ground plane substantially perpendicular to said first ground plane and said second ground plane and comprising at two selected locations two slotted main feed lines that are substantially parallel, said first ground plane comprising at two selected locations two substantially parallel slotted main feed lines, and said coupling means comprising a coupling slot having a general shape resembling a pound symbol and a first branch, a second branch, a third branch and a fourth branch that are substantially perpendicular in pairs, said first branch and said third branch being respectively coupled by a middle portion to said main feed lines of said first ground plane and said second branch and said fourth branch being respectively coupled by a middle portion to said main feed lines of said third ground plane to provide double linear polarization.

20. A device as claimed in claim 19, wherein said first ground plane and said third ground plane each comprise a coplanar connecting line having one end divided into two portions defining said two slotted main feed lines.

21. A radiating device for an antenna, comprising a first ground plane comprising a surface electric field main feed line, a second ground plane substantially perpendicular to said first ground plane and comprising electromagnetic coupling means fed orthogonally by a first end of said main feed line, and a resonant structure adapted to radiate energy at a selected wavelength in the event of excitation by electromagnetic coupling at the first end of said main feed line via said coupling means, further comprising a horn coupling to said radiating structure so as to be excited thereby in order to radiate said energy in accordance with a selected template.

22. A radiating device for an antenna, comprising:

a first ground plane comprising a surface electric field main feed line having a first end, a second ground plane substantially perpendicular to the first ground plane and comprising an electromagnetic coupling fed orthogonally by the first end of the main feed line, and a resonant structure disposed on a major face of the second ground plane, wherein the resonant structure radiates energy at a selected wavelength in an event of excitation due to an electric field in the main feed line that is transmitted to the resonant structure via the electromagnetic coupling, wherein the electromagnetic coupling comprises a coupling slot configured to couple the first end of said main feed line and the resonant structure.

* * * * *